US010919003B2

(12) United States Patent
Pongraz et al.

(10) Patent No.: US 10,919,003 B2
(45) Date of Patent: Feb. 16, 2021

(54) METHOD AND APPARATUS FOR DYNAMIC GAS MIXTURE PRODUCTION

(71) Applicant: L'Air Liquide, Société Anonyme pour l'Etude et l'Exploitation des Procédés Georges Claude, Paris (FR)

(72) Inventors: Johann Pongraz, Duisburg (DE); David Kihumbu, Dusseldorf (DE); Tracey Jacksier, Landenberg, PA (US); Denis Muller, Rueil Malmaison (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 223 days.

(21) Appl. No.: 16/044,677

(22) Filed: Jul. 25, 2018

(65) Prior Publication Data

US 2019/0046936 A1 Feb. 14, 2019

Related U.S. Application Data

(62) Division of application No. 14/344,373, filed as application No. PCT/EP2012/066114 on Aug. 17, 2012, now Pat. No. 10,058,824.

(30) Foreign Application Priority Data

Sep. 16, 2011 (EP) ..... 11181671

(51) Int. Cl.
*B01F 3/02* (2006.01)
*B01F 15/02* (2006.01)
*B01F 5/04* (2006.01)

(52) U.S. Cl.
CPC ..... *B01F 3/026* (2013.01); *B01F 3/02* (2013.01); *B01F 5/04* (2013.01); *B01F 5/0456* (2013.01); *B01F 15/0201* (2013.01)

(58) Field of Classification Search
CPC .... B01F 3/026; B01F 3/02; B01F 5/04; B01F 5/0456; B01F 15/0201
See application file for complete search history.

(56) References Cited

U.S. PATENT DOCUMENTS 2,290,838 A 7/1942 White
3,081,818 A 3/1963 Braconier et al.
(Continued)

FOREIGN PATENT DOCUMENTS

CN 1678827 10/2005
DE 20 2006 016783 1/2007
(Continued)

OTHER PUBLICATIONS

Beswick Engineering, The Basics of Pressure Regulators, https://www.beswick.com/wp-content/uploads/2018/12/Basics-of-Pressure-Regulator.pdf, 2018 (Year: 2018).*
(Continued)

*Primary Examiner* — Queenie S Dehghan
(74) *Attorney, Agent, or Firm* — Allen E. White

(57) ABSTRACT

The present invention relates to a method for producing and delivering a gas mixture having a selected composition of a first gas and at least one second gas, comprising the following steps: (a) providing a main gas flow comprising the first gas in a main conduit, (b) separating the main gas flow into a first plurality of secondary gas flows, (c) guiding each secondary gas flow through a secondary conduit, (d) adding at least one second gas to at least one of the first plurality of secondary gas flows in the respective secondary conduit through a delivering conduit, said delivering conduit protruding into the secondary conduit, and (e) combining the first plurality of secondary gas flows to the gas mixture. With the technical teaching of the present invention a dynamic gas
(Continued)

bottle filling is possible wherein the second gas components may have a concentration form some ppb to percent.

6 Claims, 7 Drawing Sheets

(56) References Cited

U.S. PATENT DOCUMENTS

| | | | | |
|---|---|---|---|---|
| 3,998,239 | A * | 12/1976 | Kruishoop | A61M 16/18 137/101.11 |
| 5,370,518 | A | 12/1994 | Sasaki et al. | |
| 5,495,875 | A | 3/1996 | Benning et al. | |
| 5,836,632 | A | 11/1998 | Pompa | |
| 2003/0081495 | A1* | 5/2003 | O'Callaghan | B01F 13/0227 366/141 |
| 2006/0092758 | A1 | 5/2006 | Ellmers | |
| 2006/0201065 | A1 | 9/2006 | Lucas et al. | |
| 2010/0191005 | A1 | 7/2010 | Andresen et al. | |
| 2012/0001125 | A1 | 1/2012 | Oguro et al. | |

FOREIGN PATENT DOCUMENTS

| | | |
|---|---|---|
| EP | 1 972 796 | 9/2008 |
| JP | S57 204031 U | 12/1982 |
| WO | WO 2009 102311 | 8/2009 |

OTHER PUBLICATIONS

European Search Report and Written Opinion for corresponding EP 11 18 1671, dated Feb. 6, 2012.

* cited by examiner

METHOD AND APPARATUS FOR DYNAMIC GAS MIXTURE PRODUCTION

CROSS REFERENCE TO RELATED APPLICATIONS

This is a divisional application of U.S. patent application Ser. No. 14/344,373, filed Nov. 20, 2014, which is a 371 of International PCT Application PCT/EP2012/066114, filed Aug. 17, 2012, which claims priority to European Patent Application No. 11181671.6 filed Sep. 16, 2011, the entire contents of which are incorporated herein by reference.

BACKGROUND

The present invention relates to a method and an apparatus for producing and delivering a gas mixture having a selected composition of a first gas and at least one second gas. In particular, the present invention is used for the dynamic production of gas mixtures.

Dynamic gas mixing is used for continuously filling cylinders with a gas mixture having a selected composition of a first (main) gas and at least one second gas. Usually the first gas, which has the highest concentration in the gas mixture, is provided in a main conduit as a main gas flow and the second gas is added into that main conduit, so that the first gas and the second gas are blended and form a gas mixture flow. The flow rate of the first gas and the flow rate of the second gas are set to such values that a gas mixture having approximately the desired composition is produced.

At selected time intervals or continuously the rate of flow of gas mixture and the composition of the gas mixture is measured as it passes a selected point. Thereby, the current concentration of each gas in the flowing gas mixture is determined. The flow rate measurement and gas mixture analysis results are used to determine the composition of the entire quantity of gas mixture that has passed the selected point. If the components in the accumulated quantity of gas mixture, that has passed the given point, are at the desired ratios, no adjustment of flow of any component of the gas mixture is necessary. If, however, the gas mixture has a composition that is beyond the predetermined composition limits, a signal is sent back to one or more flow control devices associated with gas lines that feed the first gas and the second gas into the main gas conduit to cause the flow control devices to adjust the rate of gas flow to cause the difference between the measured and targeted composition to be diminished. Analyses and flow rate adjustments are made frequently throughout the course of a filling activity, so that the composition of the gas mixture will be maintained within a narrow range.

The gas mixture is subsequently compressed and charged into a plurality of parallel aligned gas bottles. Furthermore, the apparatus may comprise purge valves and inert gas sources, so that the apparatus may be purged after each filling cycle.

Prior art document U.S. Pat. No. 5,836,632 discloses a method for dynamically filling gas cylinders with gas mixtures. The gases forming the gas mixture are separately introduced into a main conduit through individual delivering conduits at the same position of the main conduit. All gas components are added to the same space within the main conduit.

Prior art document U.S. Pat. No. 5,495,875 discloses a dynamic system for continuously filling a plurality of cylinders with a precise concentration of a vaporized liquid component blended into a gas or gas mixture. The different gas components may be added to the main gas flow in a main conduit in subsequent positions with respect to the flow direction in the main conduit. For mixing a plurality of second gases the main conduit has to have a certain length so that all gases may be added into the main conduit.

With the known systems it is not possible to produce a gas mixture which has a component with a concentration of a few percent and at the same time with a component which has a concentration of only a few ppm [parts per million] or even ppb [part per billion].

Therefore, equipment and methods are needed for producing gas mixtures containing second gases with a concentration from below a few hundreds ppm to a few percent.

SUMMARY

It is an object of the present invention to at least partially solve the problems discussed with regard to the prior art. In particular, it is sought to provide a method and an apparatus for producing and delivering a gas mixture having a selected composition allowing producing a gas mixture dynamically with a second gas component having a high precision. A further object of the present invention is to produce a gas mixture, wherein one component has a concentration below a few hundred ppm. It is also an object of the present invention to produce a gas mixture, wherein a first component has a concentration of less than a few hundred ppm and a second component has a concentration of a few percent.

Said objects are achieved by means of a method and an apparatus according to the features of the independent claims. The dependent claims specify further advantageous embodiments of the invention. It should be noted that the features specified individually in the patent claims may be combined with one another in any desired technological reasonable way and form further embodiments of the invention. The specification, in particular in connection with the figures, explains the invention further and specifies particularly preferred variants of the invention.

In particular, the objects are achieved by a method for producing and delivering a gas mixture having a selected composition of a first gas and at least one second gas, preferably at least two second gases, comprising the following steps:

a) providing a main gas flow comprising the first gas in a main conduit, b) separating the main gas flow into a first plurality of secondary gas flows, c) guiding each secondary gas flow through a secondary conduit, d) adding at least one second gas to at least one of the first plurality of secondary gas flows in the respective secondary conduit through a delivering conduit, said delivering conduit protruding into the secondary conduit, e) combining the first plurality of secondary gas flows to the gas mixture.

The first gas and the second gas may be pure gases of only one gas component, but also may be a gas mixture of a known composition. In particular, the second gas is a pure gas of only one component. The main gas flow is defined as the gas flow through a single (main) conduit, to which the second gas or second gases are added. Preferably the main gas flow rate fluctuates less than 1%. For adding the second gas or second gases to the main gas flow the main gas flow is split in method step b) into at least two or more separated secondary gas flows. This means that each secondary gas flow is separated from the other secondary gas flow by a wall, membrane or the like. Method step b) is in particular performed at the same time with method step c), according to which the secondary gas flows are produced by separating and guiding the first gas of the main gas flow into a plurality of a secondary conduit, wherein the amount of secondary conduits represents the plurality of secondary gas flows. A secondary conduit is such a conduit, in which only a part of the main gas flow is guided.

In method step d) second gases are supplied to each secondary gas flow, wherein the number of second gases may correspond to the desired amount of minor gas components in the final gas mixture. Preferably the first gas is the main component of the gas mixture and is supplied with a high flow rate of at least 20 $m^3/h$ [cubic meter per hour] or even at least 60 $m^3/h$ and wherein the second gases are the minor components of the gas mixture.

The second gases are supplied to the secondary gas flows in the respective secondary conduits. The second gases are supplied through delivering conduits. The delivering conduit is defined as the conduit between the point in the delivering conduit, where the gas flow of the secondary gas can be shut down and the outlet of the delivering conduit in the secondary conduit. The concentration of the second gas within the gas mixture depends on the gas flow within the delivering conduit. Therefore, the gas flow within the delivering conduit must be precisely adjustable. Preferably this is achieved by a small inner diameter of the delivering conduit, which is chosen according to the desired amount of second gas. Furthermore, a valve is preferred which can control the amount of second gas supplied to the delivering conduit precisely. Depending on the parameters of the delivering conduit, the parameters of the secondary flow at the end of the delivering conduit and the respective valve connected to the delivering conduit, a second gas with concentrations from ppb to a few percent of the gas mixture can be added.

In method step e) the first plurality of secondary gas flows, to which the second gases are applied, is combined to form the desired gas mixture. The combining of the first plurality of secondary gas flows may be achieved by supplying the second gas flows, to which the second gases were added, through an outlet of each secondary conduit into a main conduit again.

By separating the main gas flow into a plurality of secondary gas flows, the parameters of each secondary gas flow can be set independently, preferably by the shape, in particular the diameter of the secondary conduit. This means in particular that the conditions, at which the second gas is applied to the secondary gas flow, can be set independently for each secondary gas flow. In particular, the flow velocity of the secondary gas flow, the dynamic and/or static pressure of the secondary gas flow can be set independently. As there are at least two different conditions (corresponding to two secondary gas flows) for supplying a second gas into the gas flow, the present invention allows adding a precise amount of second gas. This is due to the fact that a condition can be generated in each secondary conduit that is favorable for an exact adding of a second gas to the gas flow in the respective secondary conduit. A plurality of second gases may be added parallelly, each having different conditions at the point of blending.

It is preferred that the temperature of the first gas and the second gas is at about ambient temperature, in particular in the range of 18° C. [degree centigrade] to 22° C. The protrusion of the delivering conduit into the secondary conduit allows an efficient mixing of the first gas and the second gas as the second gas is delivered not into the slow boundary layers of the gas flow but into the faster parts of the flow. Usually, the free diameter of the secondary conduit and the sum of the diameters of the secondary conduits are smaller than the free diameter of the main conduit resulting in an acceleration of the flow and an increase in the Reynolds-Number of the flow usually generating turbulent flow zones at least in the central region of the secondary conduits. Therefore, the protrusion of the delivery conduit improves the mixing and blending quality. Consequently, defined mixing conduits downstream can be omitted. Therefore, the length of the secondary conduits can be quite short compared to solutions known from prior art. Furthermore, it is not necessary to provide continuous widenings or reductions of the free diameter to improve the blending or mixing result. It is thus possible to provide discontinuous changes of the free diameter. This means in particular that as secondary conduits usual tubes or bores having a simple cylindrical geometry can be used. It is not necessary to provide cone shaped parts of the conduits.

The protruding part of the delivery conduit can preferably be shaped such, that the second gas is delivered in a right angle to the main flow direction in the secondary conduit or in the main flow direction in the secondary conduit. This means that the delivery conduit is protruding straight in a right angle into the secondary conduit or is bent with a 90° angle in the secondary conduit. It is preferred that the protruding part of the delivery conduit has a length in the direction of the cross-section and that the quotient of the length to the diameter of the secondary conduit is in the range of 0.35 to 0.80, in particular in the range of 0.45 to 0.625. If necessary, a further mixing can be performed downstream after step e).

Preferably the method further comprises the following steps:

f) separating the gas mixture into a second plurality of secondary gas flows, g) guiding each secondary gas flow through a secondary conduit, h) adding at least one other second gas to at least one of the second plurality of secondary gas flows in the respective secondary conduit through a delivering conduit, said delivering conduit protruding into the secondary conduit, i) combining the second plurality of secondary gas flows to the gas mixture, wherein the amount of the at least one other second gas in step h) is greater than the amount of the at least one second gas in step d).

Method steps f) to i) correspond to method steps b) to e). Therefore, the second gas, which concentration in the final gas mixture is in the range of ppm or lower, is first added to the gas mixture and subsequently the gas is added, which concentration is in the rage of a few percent. The gas added during method step d) is blended with the gas mixture between the first and the second plurality of secondary gas flows and is further blended by the second plurality of secondary gas flows. It is advantageously to add first the second gas with a minor concentration so that a uniform blending of said second gas can be achieved. If necessary, a further mixing can be performed downstream after step i).

According to a further embodiment of the invention the at least one second gas is added to the secondary gas flow through a respective delivering conduit to the center of the secondary gas flow. This means that the respective delivering conduit ends within the center of the secondary gas flow. This way the at least one second gas is added to the position where the secondary gas flow has the highest velocity and where the highest turbulences of the second gas flow exist, so that the second gas is blended with the secondary gas flow uniformly. In this respect each second gas can be added to the centre of a secondary gas flow in parallel so that each second gas can be blended with a higher efficiency. Therefore, the length, in which the second gases are added, is short.

It is further preferred that each secondary gas flow has a secondary flow direction and the at least one second gas is added to the secondary gas flow with a flow direction essentially parallel to the secondary flow direction. This means that the secondary gas exits the delivering conduit with a velocity component generally in the direction or against the direction of the secondary gas flow within the secondary conduit. This way the static and dynamic pressure at the outlet of the delivering conduit is advantageous for the precise dosing of the second gas into the secondary gas flow. This way the precision of the ratio of the components of the gas mixture can be further increased.

According to another preferred embodiment of the invention the flow rate of the second gas in the delivering conduit is adjusted by supplying the second gas with a supplying frequency to the delivering conduit. This means that the second gas within the delivering conduit does not possess a constant flow rate but a regularly changing flow rate i. e a regularly pulsating gas flow. Therefore, the flow rate can be characterized by a supplying frequency, wherein the gas flows during a supplying cycle with a supplying time. By changing the supplying frequency and/or the supplying time of each supplying cycle the amount of second gas added to the secondary gas flow can be adjusted. The supplying frequency and supplying time generally correspond to the opening frequency and opening time of a respective valve connected to the delivering conduit. In this case the amount of second gas flowing through the delivering conduit does not only depend on the exact opening degree of the respective valve but depend on the opening frequency and opening time, which can be altered with electronic equipment very precisely. This way the precision of the second gas within the gas mixture can be further increased.

Furthermore, it is preferred that a flow rate of the second gas in the delivering conduit is adjusted by opening a valve with a step motor. This means that the valve is not opened by manual operation but by a step motor which is electronically controllable. This way the opening of the valve does not depend on the capabilities of the operator and the flow rate of the second gas can be more precisely set.

Advantageously a gas flow rate of the second gas in the delivering conduit is grossly adjusted by the opening of a valve in a first step and the gas flow rate of the second gas in the delivering conduit is precisely adjusted by altering the pressure at the inlet of the valve in a subsequent step. The opening of a valve is characterized by the area, through which the medium flows. In particular, the pressure in the conduit leading the second gas to the valve is altered to precisely adjust the flow rate of the second gas. Accordingly, the flow rate of the second gas can be set with a very high precision.

According to another preferred embodiment of the invention the flow rate of the second gas in the delivering conduit is precisely adjusted by withdrawing some of the second gas out of the conduit leading to the inlet of the valve. This means that the flow rate of the second gas in the delivering conduit is grossly set by a known valve or by a before described valve and that subsequently the exact flow rate is set by actively withdrawing part of the second gas flowing in the conduit to the valve. The active withdrawing is e. g. done by a bellows. Alternatively the flow rate of the second gas in the delivering conduit is precisely adjusted by adding some second gas to the conduit leading to the valve, in particular by a bellows. This way an alternative for attaining a high precision gas mixture is given.

It is also preferred that a second gas is initially a fluid and the fluid is atomized and advanced through the delivering conduit by an atomizing gas, which can be of the kind of first gas or of second gas. This means that preferably a fluid is advanced out of a fluid reservoir to an atomizing point where the fluid is atomized by the atomizing gas, which preferably has a flow velocity rectangular to the fluid at the atomizing point. This way a fluid can be supplied to the gas mixture with a high precision.

According to another aspect of the invention an apparatus for delivering a gas mixture is suggested, comprising a main conduit with a first section and a second section, wherein the first section and the second section of the main conduit are connected by a first plurality of secondary conduits, wherein a delivering conduit ends within at least one of the first plurality of secondary conduits and protrudes into the same. The apparatus is preferably used for conducting the inventive method.

Preferably in the first section of the main conduit the first gas is conducted, to which the second gas is added within the first plurality of secondary conduits. In the second section of the main conduit the gas mixture of the first gas and the second gas, which is added in the first plurality of secondary conduits, is conducted. The plurality of secondary conduits may be of any kinds of pipe, channel, duct or the like, in which the first gas in the first section of the main conduit is conducted to the second section of the main conduit.

According to the present invention the outlet of the delivering conduit ends within at least one of the first plurality of secondary conduits and protrudes into the same, so that a second gas can be added through the delivering conduit. The secondary conduits may have all the same shape, in particular with regard to inner diameter and length but may also differ between each other. By the shape of the secondary conduit the flow properties of the secondary gas flow with respect to flow velocity, flow velocity distribution, static pressure and/or dynamic pressure can be set, wherein these values also depend on the amount and pressure of the provided first gas. This way the shape of the secondary conduits can be set such that the second gases can be added with high precision and with different amounts to the secondary gas flow.

For example by a respective design of the secondary conduits the flow velocity of a main gas flow can be increased in the secondary gas flow such that a lower static pressure and a higher dynamic pressure prevail within the secondary conduit. This way a second gas can be added with a higher precision into the secondary gas flow compared to the main gas flow. This way a plurality of second gases can be added to a gas flow in parallel with different conditions. The axial extend of the area in which the second gas can be added is minimized.

According to a further embodiment of the inventive apparatus the apparatus comprises a third section of the main conduit, which is connected to the second section of the main conduit by a second plurality of secondary conduits, wherein a delivering conduit ends within at least one of the second plurality of secondary conduits, wherein an inner diameter of the delivering conduit ending in at least one of the second plurality of secondary conduits is larger, preferably two times or even three times larger than an inner diameter of the delivering conduit ending at least in one of the first plurality of secondary conduits. Preferably the smaller inner diameter is not larger than 2 mm [millimeter], in particular not larger than 1 mm and the larger inner diameter is at least 4 mm or even at least 6 mm. This way the second gas, which has a lower concentration in the final gas mixture, is added in a first step to the gas flow so that it can be blended on a longer distance in the main conduit.

According to a further embodiment of the invention the delivering conduit is formed between a valve and the end within the secondary conduit and has a volume of less than 1 $cm^3$ [cubic centimeter] and more preferably a volume of less than 50 $mm^3$ [cubic millimeter]. By using a delivering conduit with such a low volume a second gas with a low concentration in the range of ppb can be added continuously with a high precision.

Furthermore it is preferred that the plurality of secondary conduits is formed by holes in a connecting piece, which is connected to the first and second section or to the second section and third section of the main conduit. Preferably the outer diameter of the connecting piece is similar to the outer diameter of the main conduit. Furthermore, the overall opening surface of the holes is smaller than the inner cross sectional surface of the main conduit. This way the velocity of the gas within the secondary conduits is larger than the velocity of the gas within the main conduit. This way a plurality of secondary conduits can be produced easily.

According to another preferred embodiment of the invention a valve operated by a Piezo actuator is connected to the delivering conduit. Independent of the present invention a valve operated by a Piezo actuator may be used for controlling a gas flow with a high precision. Usually valves are manually operated, wherein a valve needle is displaced against a valve seat within a valve housing for adjusting the opening of the valve. The valve usually comprises a valve housing with an inlet and an outlet, wherein the valve seat and the valve needle are placed within the valve housing. It is now suggested that the valve needle is operated by a Piezo actuator which is electronically controlled. Therefore, the opening of the valve and consequently the gas flow rate in use is controlled by the Piezo actuator.

In a further embodiment the Piezo actuator replaces or works a membrane of a membrane valve so that the opening of the membrane valve is controlled by the Piezo actuator. It is especially preferred that the Piezo actuator is connected to an alternating voltage source for operating the valve with an alternating voltage, so that the valve opens periodically with an opening frequency and an opening time in each opening cycle.

It is preferred that the piezo actuator is connected to a valve needle by a connecting rod. This way the piezo actuator must not be directly connected to the valve needle but may be arranged in or on the valve housing. Preferably the connecting rod extends through the valve seat from the valve needle to the piezo actuator. It is also preferred that an outer circumference of the valve needle is inclined less than 2°, in particular less than 1° to the displacement direction of the valve needle.

According to another embodiment of the invention a valve operated by a step motor is connected to the delivering conduit. The step motor is electronically controllable so that the precision of the filling process is higher and reproducible compared to manual handling.

It is also preferred that a pressure regulator, in particular a bellows is connected to the inlet of a valve connected to the delivering conduit. The bellows is used to withdraw or add additional second gas to the delivering conduit. In this connection the gross adjustment of the flow rate of the second gas within the delivering conduit can be set by a valve and the fine adjustment of the flow rate can be achieved by the bellows, which withdraws or adds additional second gas to the delivering conduit. This way a higher precision of the second gas within the gas mixture can be attained.

In another preferred embodiment of the invention a fluid source, a gas source and the delivering conduit are connected to a valve. This way a fluid from the fluid source may be atomized by gas from the gas source at the valve and may be applied through the delivering conduit into the second conduit. Preferably the inlet from the fluid source and the inlet of the gas source of the valve are next to each other within the valve.

According to another aspect of the invention a dynamic mixer for producing a selected composition of a first gas and at least one second gas is suggested comprising an inventive apparatus and a control unit, which operates the dynamic mixer in accordance with the inventive method. The dynamic mixer may further comprise gas sources for the first gas and the second gas, control valves connected to the control unit, analyzing units for analyzing the composition of the gas mixture and gas bottles for filling the gas mixture into.

The dynamic mixer is preferably operated for dynamically filling gas bottles as described in U.S. Pat. No. 5,826,632. It is possible to provide a further static mixer downstream of the dynamic mixer.

Advantages of the method according to the present invention are transferable and applicable to the apparatus to the present invention and vice versa.

BRIEF DESCRIPTION OF THE DRAWINGS

Particularly preferred variants of the invention and also the technical field will now be explained in more detail on the basis of the figures. It should be noted that the exemplary embodiments shown in the figures are not intended to restrict the invention and are schematically shown in.

DESCRIPTION OF PREFERRED EMBODIMENTS

Figure 1:
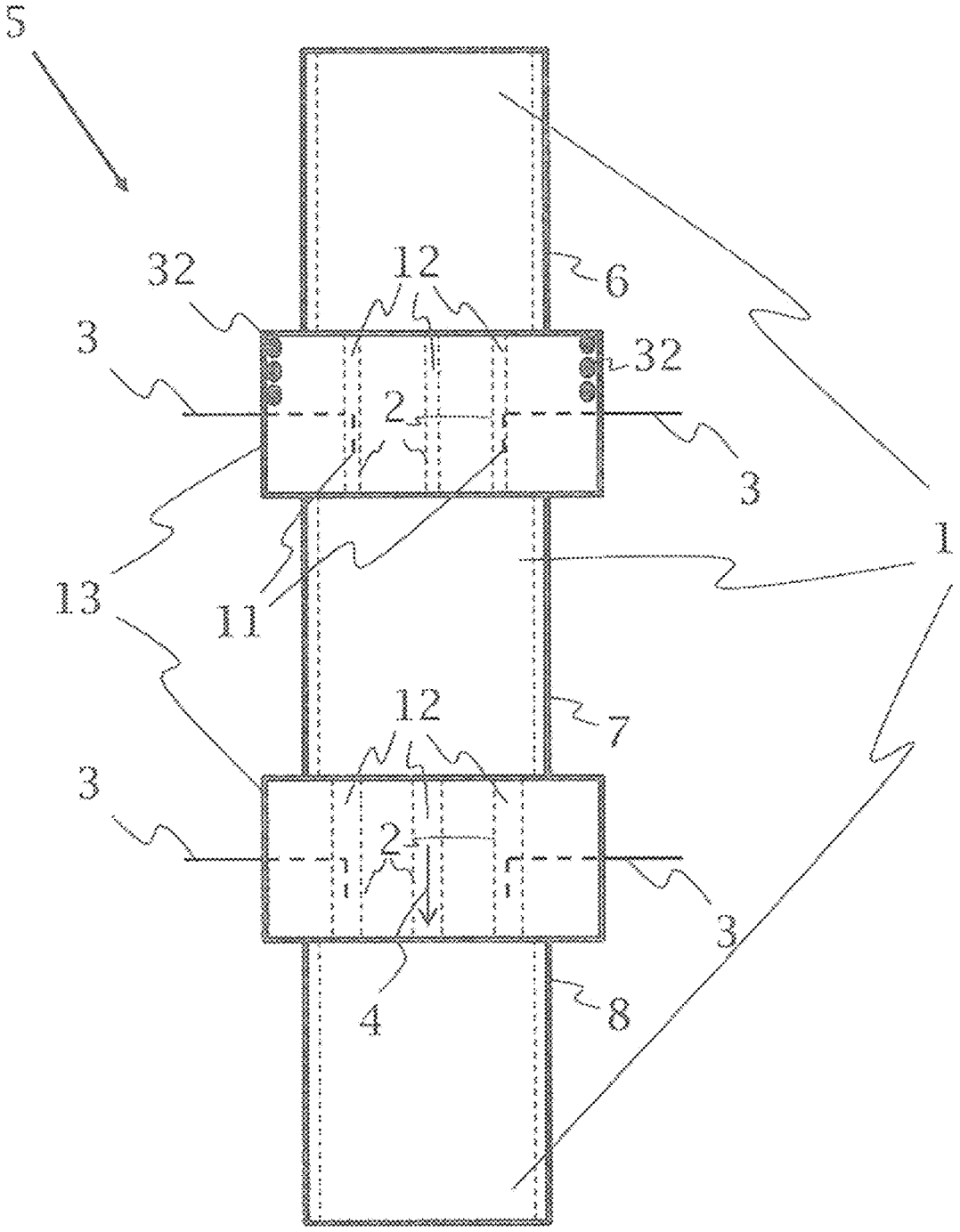
FIG. 1 illustrates a first embodiment of the inventive apparatus.

FIG. 1 displays schematically a first embodiment of an inventive apparatus 5. The apparatus 5 comprises a main conduit 1 with a first section 6, a second section 7 and a third section 8. Both the first section 6 and the second section 7 and the second section 7 and the third section 8 are connected by a connecting piece 13, respectively. The connecting pieces 13 comprise holes 12 which form secondary conduits 2. Within each secondary conduit 2 ends a delivering conduit 3 with an end 11 protruding into the respective secondary conduit 2. Temperature control elements 32 are connected to the connecting piece 13 to keep the temperature of the connecting piece 13 constant at a predetermined temperature.

In operation a first gas is provided in the first section 6 of the main conduit 1 and flows in the figure from top to bottom as a main gas flow. The main gas flow is separated into secondary conduits 2 in connecting piece 13 forming a first plurality of secondary gas flows having a secondary gas flow direction 4. A second gas is added to at least a part of the secondary gas flows within the secondary conduits 2 through one or more delivering conduits 3. As the overall cross section of the holes 12 is smaller than the cross section of the main conduit 1 the flow velocity within secondary conduits 2 is larger than the flow velocity in the main conduit 1. The added second gas blends with the secondary gas flow and is advanced into the second section 7 of the main conduit 1. The blended gas mixture is again separated into the secondary conduits 2 of the downstream connecting piece 13 forming a second plurality of secondary gas flows. The inner diameter of the secondary conduits 2 and the inner diameter of the delivering conduits 3 ending in the downstream secondary conduits 2 are larger than the inner diameters of the respective parts of the upstream connecting piece 13. This way the concentration of the second gas in the final gas mixture added in the downstream connecting piece 13 can be larger than the concentration of the second gases added in the upstream connecting piece 13.

Figure 2:
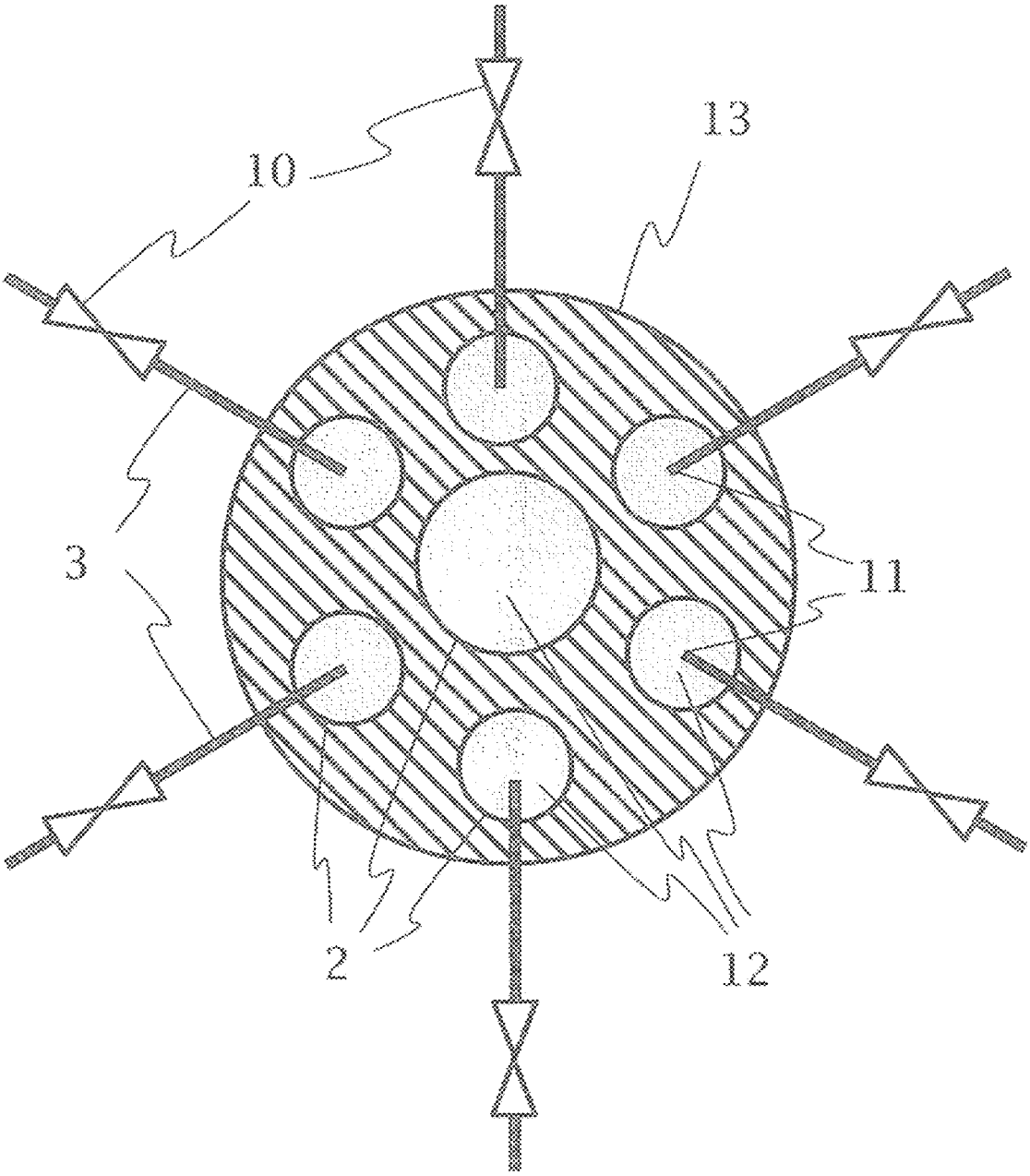
FIG. 2 illustrates a cross sectional view of the first embodiment of the inventive apparatus.

In FIG. 2 a cross sectional view through a connecting piece 13 of the embodiment in FIG. 1 is depicted. A connecting piece 13 comprises holes 12, which form secondary conduits 2. Within each of the six outer secondary conduits 2 ends a delivering conduit 3 protruding into the secondary conduit 2, wherein each delivering conduit 3 extends from a valve 10 to an end 11 of the delivering conduit 3 within the secondary conduit 2.

Figure 3:
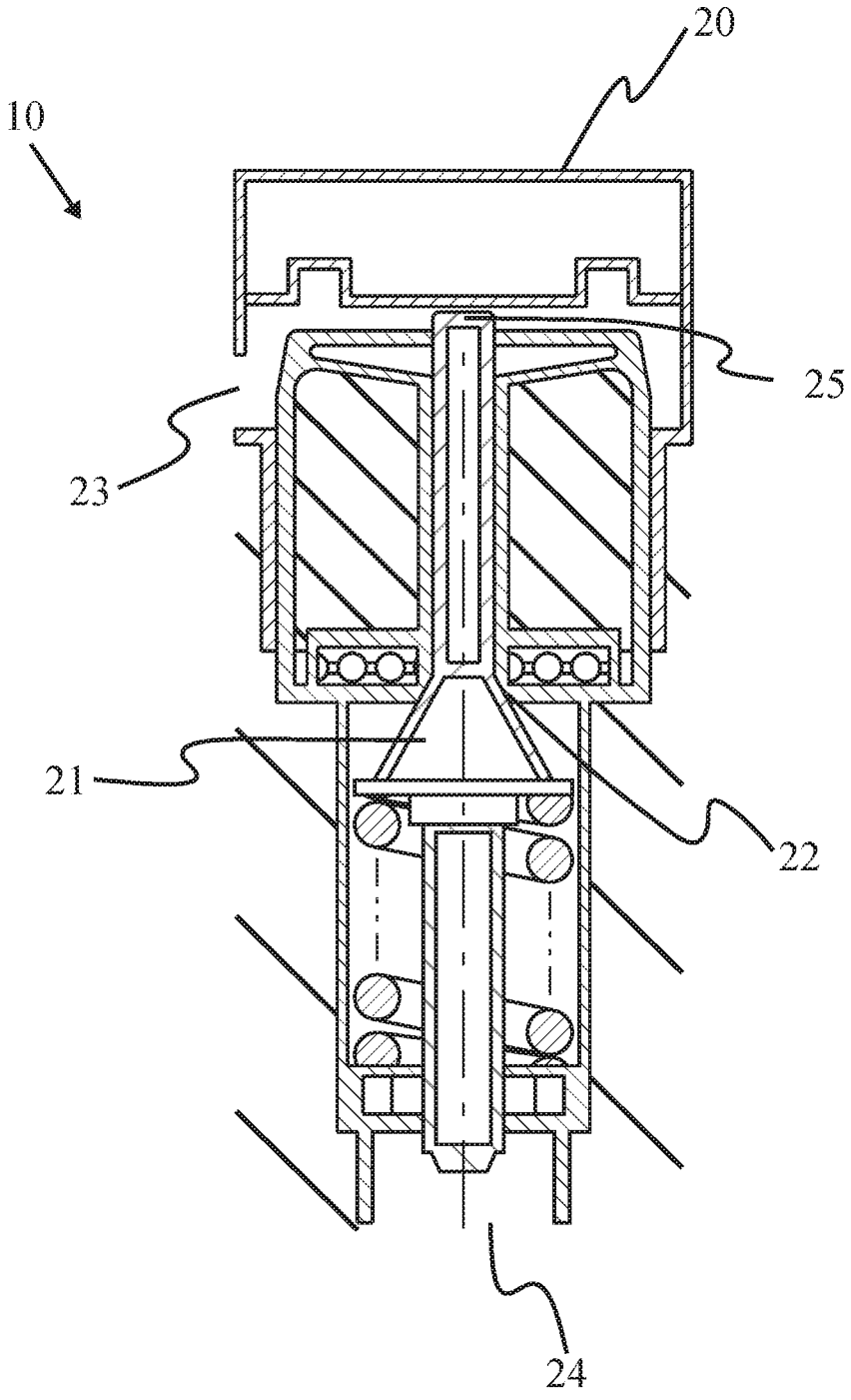
FIG. 3 illustrates a valve operated by a Piezo actuator.

FIG. 3 discloses schematically a valve 10 being operated by a Piezo actuator 20. The valve 10 comprises a valve needle 21 which is pressed against a valve seat 22. A working gas is introduced through valve inlet 23 and can be conducted through the valve 10 to a valve outlet 24. A valve seat opening 25 is opened and closed by the Piezo actuator 20 so that the amount of gas guided through the valve 10 can be regulated by an opening time of valve seat opening 25 and opening frequency, which are also called supplying frequency and supplying time.

Figure 4:
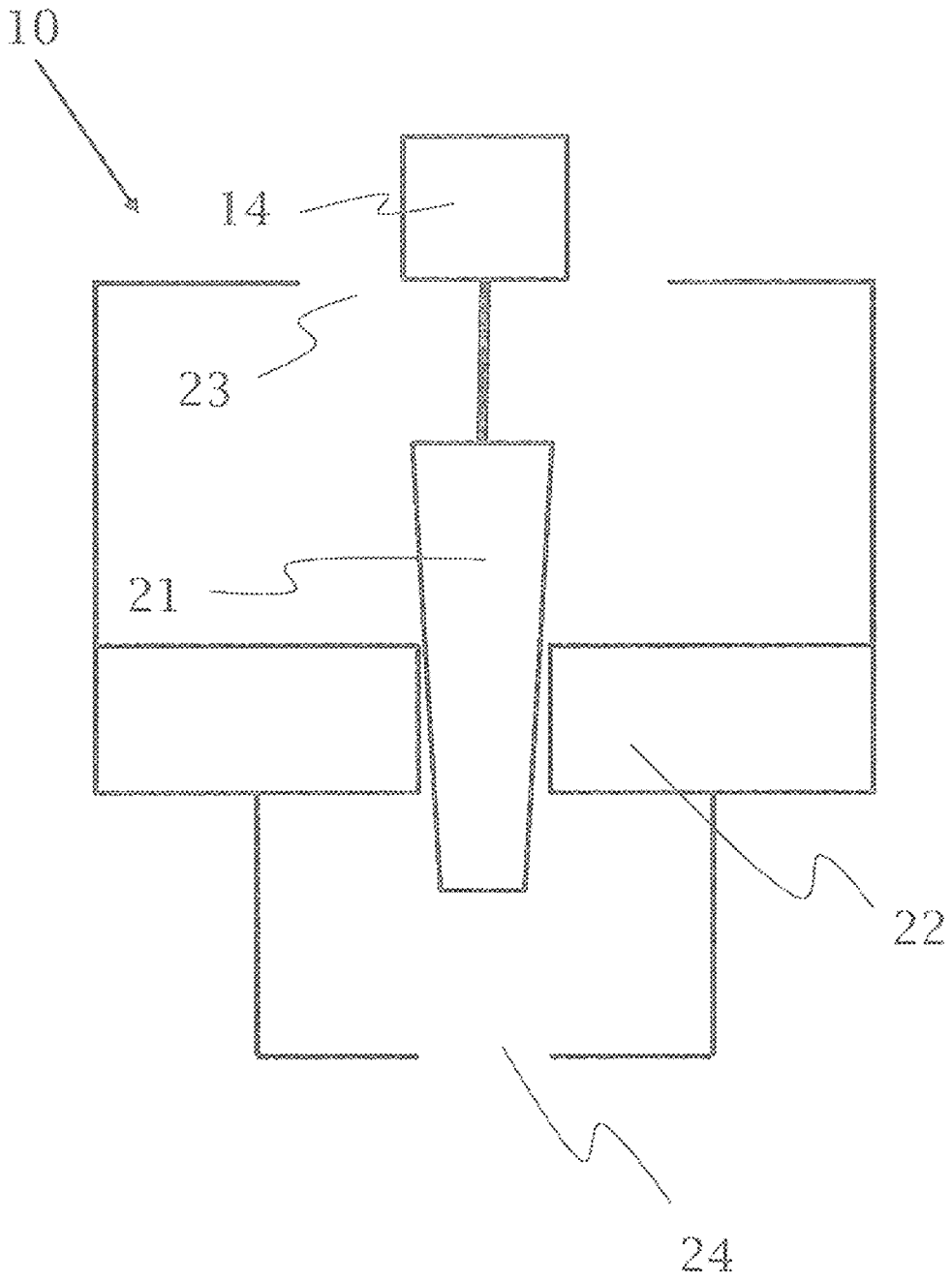
FIG. 4 illustrates a valve operated by a step motor.

In FIG. 4 a high precision valve 10 is depicted. The valve 10 is adjustable by a step motor 14 which operates the valve needle 21, which has an inclination to the vertical of less than 1°. The step motor 14 may force the valve needle 21 away from the valve seat 22 so that a second gas may advance from the valve inlet 21 to the valve outlet 24.

Figure 5:
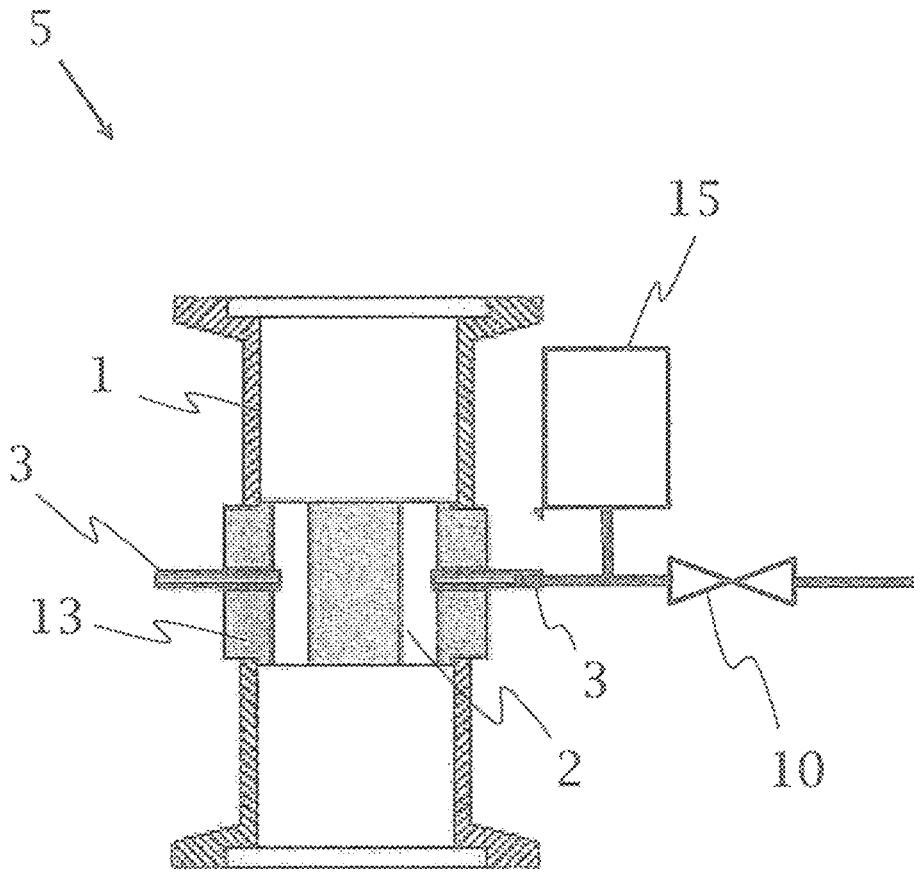
FIG. 5 illustrates a second embodiment of the inventive apparatus.

FIG. 5 depicts schematically a second embodiment of the apparatus 5. The apparatus 5 comprises a main conduit 1 which is connected to a connecting piece 13, in which secondary conduits 2 are formed. Delivering conduits 3 end within the secondary conduits 2. A second gas is introduced into the secondary conduit 2 by at least one of the delivering conduits 3. The gross adjustment of the amount of second gas supplied by delivering line 3 is adjusted by a valve 10. The fine adjustment of the amount of second gas delivered through delivering line 13 is adjusted by a bellows 15 which is connected to the delivering line 3. The fine adjustment of the flow rate of the second gas in conduit 3 is achieved by withdrawing or adding the second gas by the bellows 15 connected to the delivering conduit 3.

Figure 6:
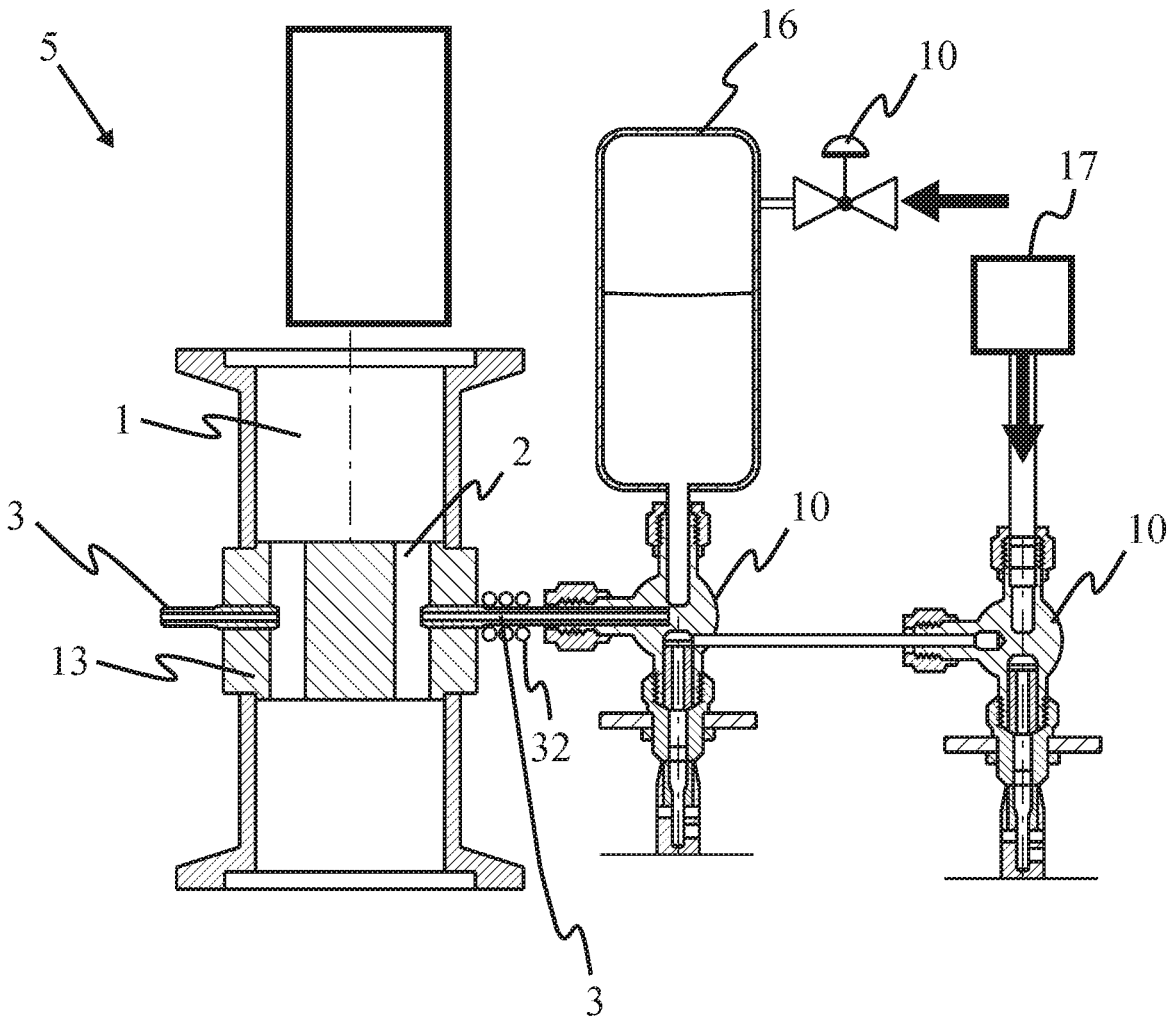
FIG. 6 illustrates a third embodiment of the inventive apparatus.

FIG. 6 displays a third embodiment of an apparatus 5 which is similar to the apparatus shown in FIG. 5. In this embodiment a fluid source 16 is connected to one of the delivering conduits 3. The fluid within the fluid source 16 can be pressurized. The fluid is advanced to the valve 10 below the fluid source 16 where it is atomized by a gas which is supplied through a supplying conduit 9 connected to gas source 17. The gas atomizes the fluid from the fluid source 16 and advances the atomized fluid to the secondary conduit 2. A temperature control element 32 is connected to the delivering conduit 3 to keep its temperature constant, which would otherwise be reduced by the evaporating fluid.

Figure 7:
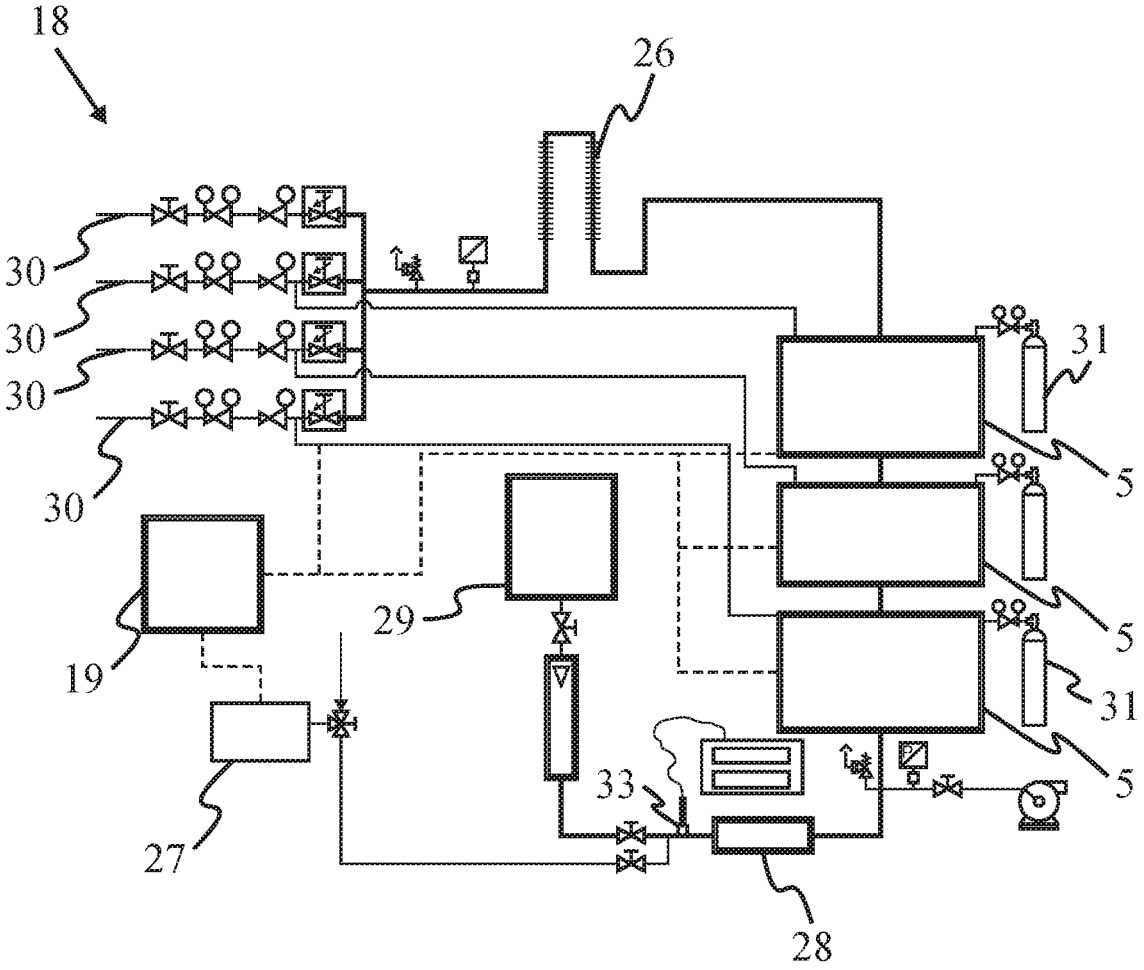
FIG. 7 illustrates a dynamic mixer according to the present invention.

FIG. 7 depicts a dynamic mixer 18 with several inventive apparatuses 5. Gases from feed lines 30 can be applied over a evaporator 26 as a first gas to the apparatuses 5, thus forming a main gas flow in the apparatuses 5. Alternatively the gases supplied by feed line 30 can be conducted as second gases to the apparatuses 5 and thus be dosed according to the inventive method. Furthermore, second gases in gas bottles 31 may be applied to the apparatuses 5 to be added to the main gas flow according to the present invention. The gases may be supplied as second gases with a concentration between ppb and percent depending on the delivering conduit 3 and secondary gas flow properties in the secondary conduits 2. The gas mixture is further guided to a mixer 28. A sample of the gas mixture is taken by analyzer 27 for evaluating the concentration of the gases in the gas mixture. The gas mixture is further compressed in compressor 29 and filled in bottles. The temperature of the gas mixture can be measured by temperature sensor 33.

A control unit 19 is connected to the analyzer 27, to the apparatuses 5, the temperature sensor 33 and to the feed lines 30. The control unit 19 operates these elements to generate a gas mixture with predetermined composition to be filled in the bottles. This is achieved by permanently analyzing the gas mixture and resetting the amount of added gases so that the final gas composition has the desired composition.

With the technical teaching of the present invention a dynamic gas bottle filling is possible wherein the second gas components may have a concentration from ppb to percent.

REFERENCE SIGNS

1 main conduit
2 secondary conduit
3 delivering conduit
4 secondary flow direction
5 apparatus
6 first section
7 second section
8 third section
9 supplying conduit
10 valve
11 end
12 hole
13 connecting piece
14 step motor
15 bellows
16 fluid source
17 gas source
18 dynamic mixer
19 control unit
20 piezo actuator
21 valve needle
22 valve seat
23 valve inlet
24 valve outlet
25 valve seat opening
26 evaporator
27 analyzer
28 mixer
29 compressor
30 feed line

31 gas bottle
32 temperature control element
33 temperature sensor
34 connecting rod

What is claimed is:

1. A method for producing and delivering a gas mixture having a selected composition of a first gas and at least one second gas comprising the following steps:

a) providing a main gas flow comprising the first gas in a main conduit (1), b) separating the main gas flow into a first plurality of secondary gas flows, c) guiding each secondary gas flow through a secondary conduit (2), d) adding at least one second gas through a delivering conduit (3) to at least one of the first plurality of secondary gas flows in the respective secondary conduit (2), said delivering conduit (3) protruding into the secondary conduit (2), e) combining the first plurality of secondary gas flows to form a first gas mixture, f) separating the first gas mixture into a second plurality of secondary gas flows, g) guiding each secondary gas flow through a secondary conduit (2), h) adding at least one other second gas through a delivering conduit (3) to at least one of the second plurality of secondary gas flows in the respective secondary conduit (2), said delivering conduit (3) protruding into the secondary conduit (2), i) combining the second plurality of secondary gas flows to form a second gas mixture, wherein the amount of the at least one other second gas in step h) is greater than the amount of the at least one second gas in step d).

2. The method according to claim 1, wherein the at least one second gas is added to the secondary gas flow through a respective delivering conduit (3) to the center of the secondary gas flow.

3. The method according to claim 1, wherein a flow rate of the second gas in the delivering conduit (3) is adjusted by supplying the second gas to the delivering conduit (3) using a supplying frequency.

4. The method according to claim 1, wherein a gas flow rate of the second gas in the delivering conduit (3) is grossly adjusted by the opening of a valve (10) in a first step and wherein the gas flow rate of the second gas in the delivering conduit (3) is precisely adjusted by altering the pressure at the inlet of the valve (10) in a subsequent step.

5. The method according to claim 1, wherein a gas flow rate of the second gas in the delivering conduit (3) is grossly adjusted by the opening of a valve (10) in a first step and wherein a flow rate of the second gas in the delivering conduit (3) is precisely adjusted by withdrawing some of the second gas out of the conduit leading to the inlet of the valve (10).

6. The method according to claim 1, wherein the second gas is initially a fluid and is atomized and advanced through the delivering conduit (3) by an atomizing gas.

* * * * *